US005975149A

United States Patent [19]

Lee et al.

[11] Patent Number: 5,975,149

[45] Date of Patent: Nov. 2, 1999

[54] MULTILAYER PRESS FABRIC INCLUDING LONG FLOATS OF HIGH TEMPERATURE MD YARNS IN THE PAPER SUPPORT LAYER

[75] Inventors: Henry J. Lee, Summerville; Paul H. Sutherland, Simpsonville, both of S.C.

[73] Assignee: Asten, Inc., Charleston, S.C.

[21] Appl. No.: 09/131,768

[22] Filed: Aug. 11, 1998

[51] Int. Cl.[6] ..... D03D 13/00

[52] U.S. Cl. ..... 139/383 A; 139/425 A; 442/207; 442/208; 162/902

[58] Field of Search ..... 139/338 A, 425 A; 442/207, 208; 162/902

[56] References Cited

U.S. PATENT DOCUMENTS

| | | | |
|---|---|---|---|
| 1,812,148 | 6/1931 | Hindle . | |
| 1,991,366 | 2/1935 | Barrell . | |
| 2,208,090 | 7/1940 | Whittier . | |
| 2,854,032 | 9/1958 | Santos . | |
| 2,862,283 | 12/1958 | Rasero . | |
| 2,947,328 | 8/1960 | Asten et al. . | |
| 4,015,038 | 3/1977 | Romanski et al. . | |
| 4,186,780 | 2/1980 | Josef et al. . | |
| 4,403,632 | 9/1983 | Romanski . | |
| 4,503,113 | 3/1985 | Smart . | |
| 4,621,663 | 11/1986 | Malmendier . | |
| 4,820,571 | 4/1989 | Searfass | 139/383 A |
| 4,896,702 | 1/1990 | Crook | 139/383 A |
| 5,245,939 | 9/1993 | Rouhling | 139/383 A |
| 5,366,798 | 11/1994 | Ostermayer | 139/383 A |
| 5,482,567 | 1/1996 | Barreto | 139/383 A |

*Primary Examiner*—Andy Falik
*Attorney, Agent, or Firm*—Volpe and Koenig, P.C.

[57] ABSTRACT

A papermaker's fabric of a type for use in high temperature operations and including interwoven machine direction (MD) and cross-machine direction (CMD) yarns that define a base fabric and a paper support layer. The fabric is characterized by the paper support layer including high temperature MD yarns woven in a repeat pattern that includes a float over at least seven CMD yarns.

18 Claims, 3 Drawing Sheets

100
122
124
120
110a
110b
110c
110d
110e
110f
110g
110h
110i
110j
110k
110l
110m
110n
110o
110p

MULTILAYER PRESS FABRIC INCLUDING LONG FLOATS OF HIGH TEMPERATURE MD YARNS IN THE PAPER SUPPORT LAYER

BACKGROUND OF INVENTION

1. Field of the Invention

The present invention generally relates to a woven fabric designed for use in a papermaking machine. More particularly, the present invention relates to a woven fabric for use in a high temperature section of a papermaking machine. Most particularly, the present invention relates to a woven fabric for use in an impulse drying press section of a papermaking machine.

2. Description of the Prior Art

A conventional papermaking machine forms a web by depositing a slurry of pulp fibers to be formed into a paper sheet on a traveling forming wire. After initial dewatering on the forming wire, the paper sheet or web is transferred to a press section where the web passes through a number of press nips formed between roll couples. The press nips serve to consolidate the solid ingredients of the paper and at the same time to increase the dewatering of the slurry. Thereafter, the web passes over a series of heated dryer drums and possibly through a calendar. While there are many variations in the various sections of the machine, in a typical machine, the web usually arrives at the press section with about 80% wet base moisture and leaves the press section with approximately 60% wet base moisture. The remaining moisture is removed in the dryer section as the web passes over a series of heated drums.

To reduce the number of heated drums, a method of dewatering known as "impulse drying" has been introduced. In impulse drying, a paper sheet is passed through press rolls having at least one of the rolls being a high temperature roll having a typical surface temperature of 300° F. or greater.

As a result of impulse drying, the paper sheet leaves the press nip at a substantially lower moisture content than with conventional pressing technology. The effectiveness of the system is such that the total number of dryer drums in a papermaking machine can be substantially reduced. Under certain conditions, improved paper properties can also result. The major drawback to this method is the high temperature of the press roll produces severe operating conditions for the press fabric. As such, standard press fabrics generally degrade rapidly when subjected to the high temperature and moisture conditions of an impulse drying section. Traditional high temperature fabrics do not provide the necessary resiliency and paper forming characteristics required in an impulse press section.

Accordingly, there is a need for a press fabric which can withstand impulse drying techniques while maintaining the necessary characteristics of a press fabric.

SUMMARY OF THE INVENTION

The present invention generally relates to a papermaker's fabric of a type for use in high temperature operations. The fabric has interwoven machine direction (MD) and cross-machine direction (CMD) yarns that define a base fabric and a paper support layer. The fabric is characterized by the paper support layer including high temperature MD yarns woven in a repeat pattern that includes a float over at least seven CMD yarns.

DESCRIPTION OF THE PREFERRED EMBODIMENTS

Figures 1A, 1B, 1C, 1D:
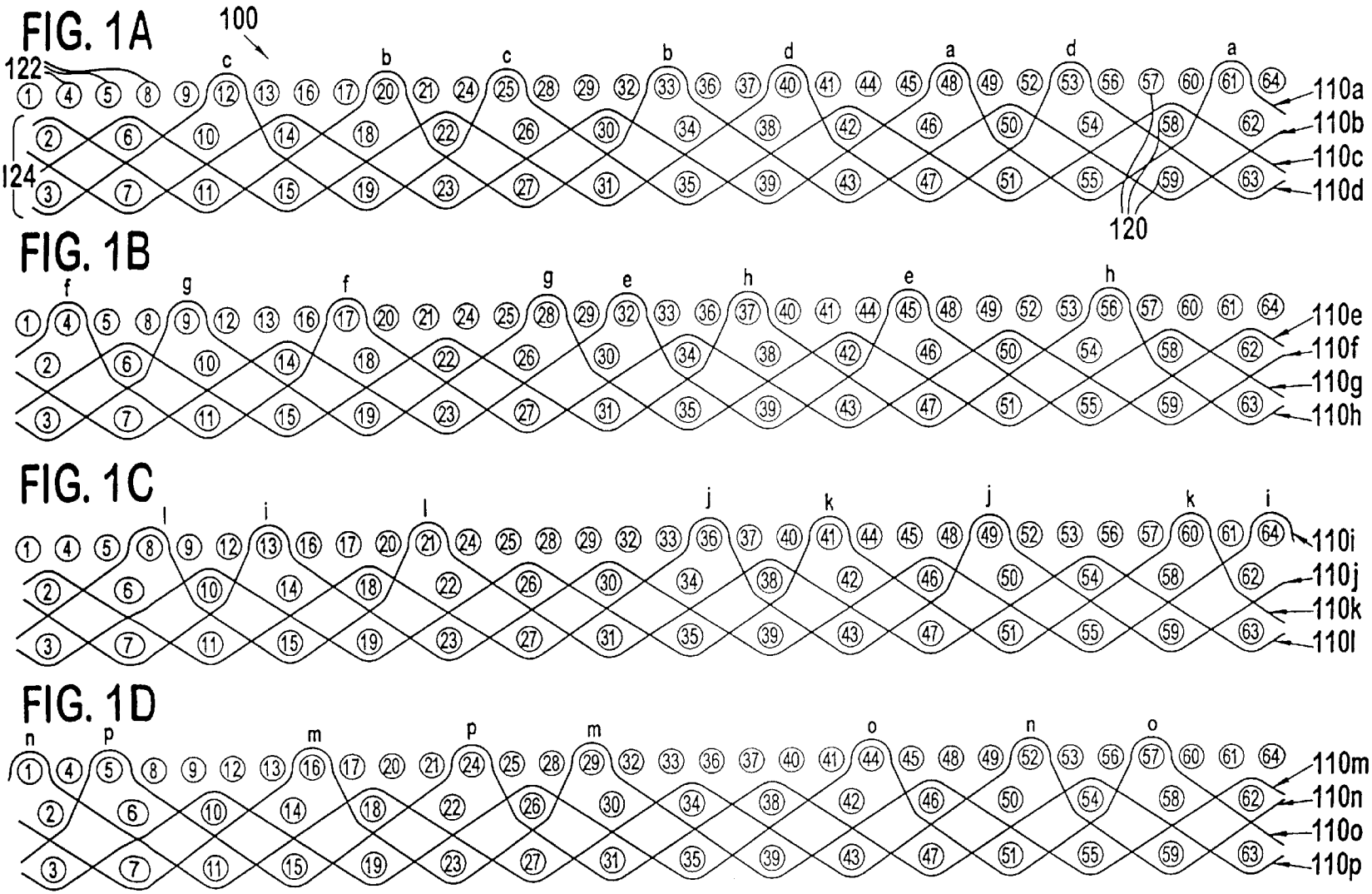
FIGS. 1*a–d* are weave structure diagrams of the preferred fabric of the present invention.
Figure 2:
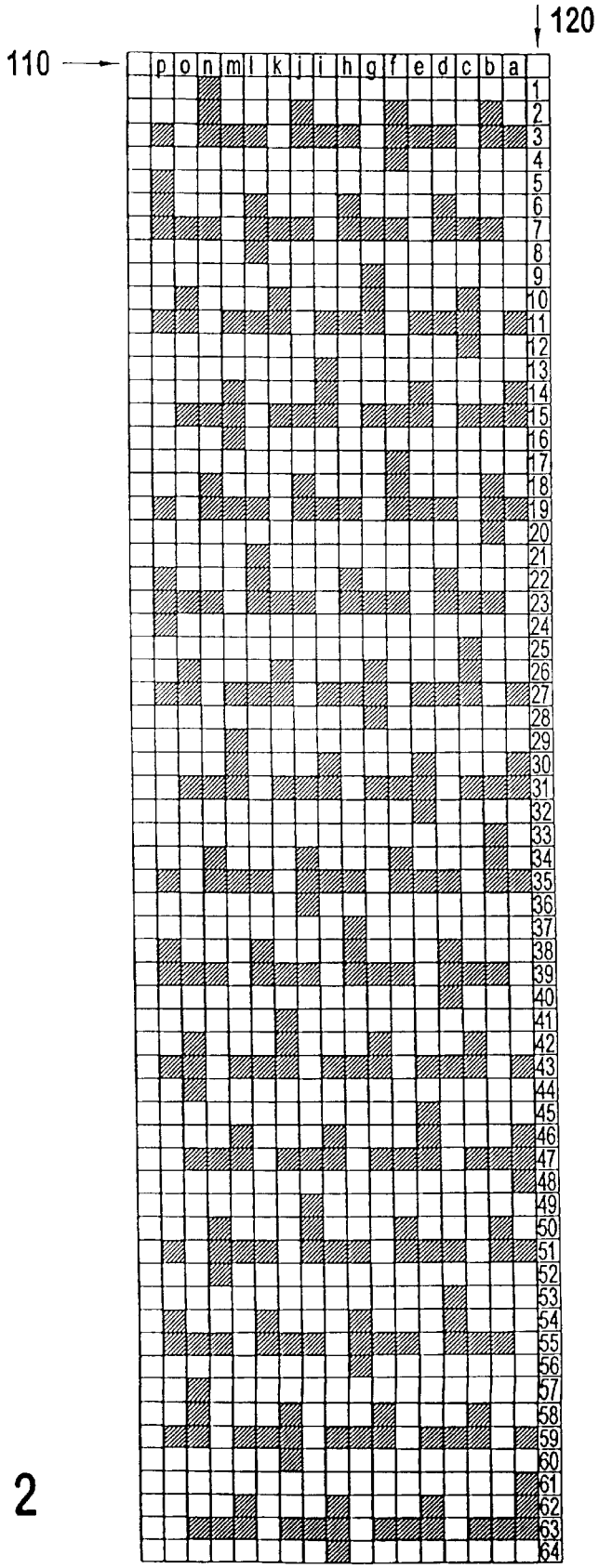
FIG. 2 is a weave pattern diagram of the preferred fabric.

The preferred embodiment will be described with reference to the drawing figures where like numerals represent like elements throughout.

Referring to FIG. 1, the preferred fabric 100 is shown. It generally comprises a system of cross-machine direction (CMD) yarns 110 interwoven with a system of machine direction yarns 120. The MD yarn system includes an upper paper contacting layer 122 and a base layer 124. The base layer 124 includes pairs of stacked MD yarns 120. The upper layer 122 includes two adjacent MD yarns 120 for every stacked pair of yarns in the base layer 124.

The CMD yarns 110 preferably repeat on sixty-four MD yarns 120 and weave with only two upper layer MD yarns 122 in a given repeat. For example, CMD yarn 110*a* weaves in a standard "N" weave pattern with the base layer 124 until it weaves over upper layer MD yarn 48 and then again over upper MD yarn layer 61. These "stitching points" 48 and 61 integrate the upper and lower layers 122 and 124 together. As shown in FIGS. 1*a*–1*d* and FIG. 2, yarn 110*b* stitches over yarns 20 and 33; yarn 110*c* stitches over yarns 12 and 25; yarn 110*d* stitches over yarns 40 and 53; yarn 110*e* stitches over yarns 32 and 45; yarn 110*f* stitches over yarns 4 and 17; yarn 110*g* stitches over yarns 9 and 28; yarn 110*h* stitches over yarns 37 and 56; yarn 110*i* stitches over yarns 13 and 64; yarn 110*j* stitches over yarns 36 and 49; yarn 110*k* stitches over yarns 41 and 60; yarn 1101 stitches over yarns 8 and 21; yarn 110*m* stitches over yarns 16 and 29; yarn 110*n* stitches over yarns 1 and 52; yarn 110*o* stitches over yarns 44 and 57; and yarn 110*p* stitches over yarns 5 and 24.

Figure 3:
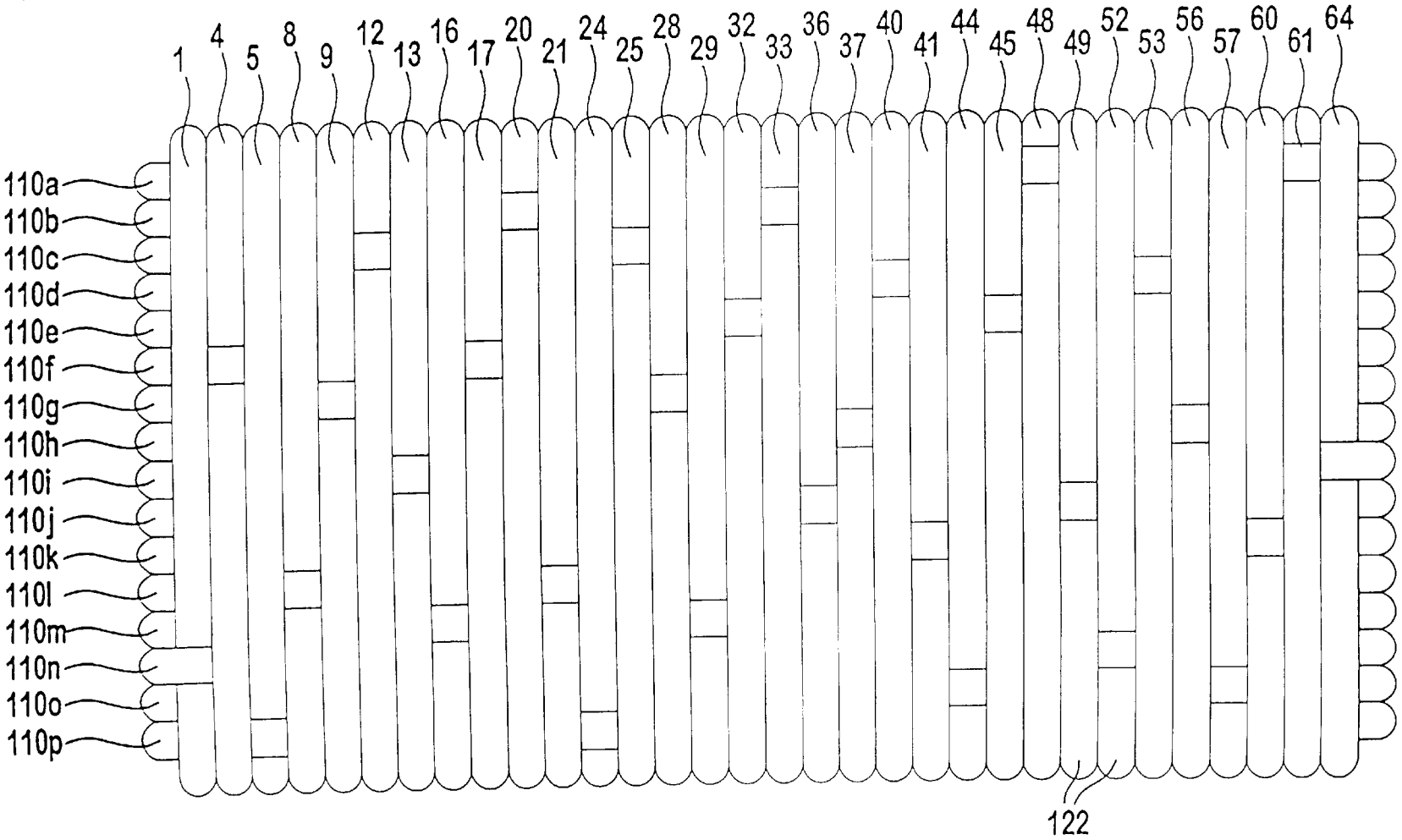
FIG. 3 is a top plan view of the preferred fabric.

As seen in FIG. 3, the reduced number of stitching points produces floats in the upper layer MD yarns 122 that pass over fifteen of the CMD yarns 120 in a given repeat. This produces a fine, uniform, porous surface for contact with the paper forming sheet.

The long floats with minimum interlacings on the paper contacting surface means that the upper layer MD yarns 122 are not closely connected to the base fabric and may move somewhat independently as they pass around the rolls. This provides resiliency in layer 122 as the fabric 100 passes between the press rolls. While it is presently preferred that the upper layer MD yarns float over fifteen CMD yarns 110 in a given repeat, it is expected that a float of at least seven CMD yarns 110 will allow the independent movement and resiliency.

The upper layer MD yarns 122 are preferably made from temperature resistant materials to protect the fabric 100 as it passes through high temperature applications, generally those above 200° F. The minimum interlacings allow the high temperature yarns 122 to be woven with minimum crimping. Yarns 122 may be spun, multifilament or cabled yarns. Preferably yarns 122 are spun or multifilament yarns made from polyphenylene sulfide (PPS), ryton, polyetheretherketone (PEEK), acrylic, aramids, rayon, polybenzimidazole (PBI), fluorocarbons, ceramics, glass or metallics.

The base layer MD yarns 124 and the CMD yarns 110 can be produced from various materials. The base layer MD yarns 124 are preferably made from a material having good tensile strength. Since the MD yarns 124 of the base layer are selected for tensile strength, the upper MD yarns 122 are not required to be load bearing yarns. The fabric 100 can be endless woven or flat woven. If the fabric is endless woven, the upper layer MD yarns 122 are preferably formed endless and the lower layer MD yarns can be formed endless or with seaming means, such as seam loops. If the fabric 100 is flat woven, the lower MD layer 124 is provided with seaming means. Preferably, the lower layer MD yarns 124 form seam loops for joining the ends of the fabric 100. The upper layer MD yarns 122 may be provided with seam loops, however, this is not preferred.

We claim:

1. A papermaker's fabric of a type for use in high temperature operations and having interwoven machine direction (MD) and cross-machine direction (CMD) yarns, the MD yarns including a first system of yarns that define a base fabric and a second system of yarns that define a paper support layer, at least some of the CMD yarns interweaving with both MD yarn systems, the fabric characterized by:

the paper support layer MD yarns including high temperature yarns woven in a repeat pattern that includes a float over at least seven of the CMD yarns interwoven with both MD yarn systems.

2. The fabric according to claim 1 wherein the paper support layer high temperature MD yarns float over at least fifteen of the CMD yarns interwoven with both MD yarns systems.

3. The fabric of claim 2 wherein the base fabric includes pairs of stacked MD yarns.

4. The fabric of claim 2 wherein each of the CMD yarns is interwoven with both MD yarns systems.

5. The fabric of claim 4 wherein the CMD yarns repeat on sixty four first and second system MD yarns.

6. The fabric of claim 3 wherein the paper support layer includes two adjacent MD yarns for each stacked pair of base fabric MD yarns.

7. The fabric of claim 6 wherein each CMD yarn weaves under a base fabric MD yarn stacked pair, between a base fabric MD yarn stacked pair, over a paper support layer MD yarn, between a base fabric MD yarn stacked pair, under a base fabric MD yarn stacked pair, between a base fabric MD yarn stacked pair, over a paper support layer MD yarn, between a base fabric MD yarn stacked pair, under a base fabric MD yarn stacked pair, between a base fabric MD yarn stacked pair, over a base fabric MD yarn stacked pair, between a base fabric MD yarn stacked pair, under a base fabric MD yarn stacked pair, between a base fabric MD yarn stacked pair, over a base fabric MD yarn stacked pair, and between a base fabric MD yarn stacked pair in a given repeat.

8. The fabric of claim 1 wherein each of the CMD yarns is interwoven with both MD yarns systems.

9. The fabric of claim 8 wherein each CMD yarn weaves with only two paper support layer MD yarns in a given repeat.

10. The fabric of claim 8 wherein the CMD yarns repeat on thirty-two MD yarns.

11. The fabric of claim 1 wherein the CMD yarns which interweave with both MD yarn systems, are high temperature yarns.

12. The fabric of claim 1 wherein the MD yarns are warp yarns and the CMD yarns are weft yarns.

13. The fabric of claim 1 wherein the MD yarns are weft yarns and the CMD yarns are warp yarns.

14. The fabric of claim 1 wherein the base fabric includes pairs of stacked MD yarns.

15. The fabric of claim 14 wherein the paper support layer includes two adjacent MD yarns for each stacked pair of base fabric MD yarns.

16. The fabric of claim 15 wherein each CMD yarn weaves under a base fabric MD yarn stacked pair, between a base fabric MD yarn stacked pair, over a paper support layer MD yarn, between a base fabric MD yarn stacked pair, under a base fabric MD yarn stacked pair, between a base fabric MD yarn stacked pair, over a paper support layer MD yarn, and between a base fabric MD yarn stacked pair in a given repeat.

17. The fabric of claim 1 wherein the high temperature MD yarns are manufactured from materials selected form the group consisting of polyphenylene sulfide (PPS), ryton, polyetheretherketone (PEEK), acrylic, aramids, rayon, polybenzimidazole (PBI), fluorocarbons, ceramics, glass and metallics.

18. The fabric of claim 1 wherein each of the MD yarns is a high temperature yarn woven in a repeat pattern that includes a float over at least seven of the CMD yarns interwoven with both MD yarn systems.

* * * * *